US005956867A

United States Patent [19]

Harton

[11] Patent Number: 5,956,867

[45] Date of Patent: Sep. 28, 1999

[54] CONTOURED COVER FOR ICE SKATE BOOT

[76] Inventor: Juliette Harton, 316-½ 13th St., Seal Beach, Calif. 90740

[21] Appl. No.: 09/066,724

[22] Filed: Apr. 23, 1998

Related U.S. Application Data

[60] Provisional application No. 60/045,101, Apr. 25, 1997.

[51] Int. Cl.[6] ..... A43B 3/16; A43B 3/18; A43B 5/04

[52] U.S. Cl. ..... 36/7.1 R; 36/7.2; 36/115

[58] Field of Search ..... 36/115, 7.1 R, 36/7.2, 7.3, 7.4, 7.5, 7.6, 7.7, 7.8

[56] References Cited

U.S. PATENT DOCUMENTS

| | | | |
|---|---|---|---|
| 2,190,579 | 2/1940 | Wash | 36/7.1 R |
| 2,235,490 | 3/1941 | Saksa | 36/7.2 X |
| 2,984,917 | 5/1961 | Saunders | 36/115 X |
| 3,027,660 | 4/1962 | Werner | 36/7.1 R |
| 3,308,562 | 3/1967 | Zimmon | 36/7.1 R |
| 3,875,687 | 4/1975 | Henderson | 36/7.1 R |
| 4,445,287 | 5/1984 | Garcia | 36/7.2 X |
| 4,461,098 | 7/1984 | Diegelman | 36/7.1 R X |
| 5,165,182 | 11/1992 | Michael | 36/7.1 R X |
| 5,544,430 | 8/1996 | Jacko | 36/7.1 R X |

OTHER PUBLICATIONS

Jerry's, "Jerry's Skating Trends 1997 Catalog," Jerry's Skating Trends 1997 Catalog, 3 pages (p. 30), Published Mar. 1997 in Canada.

Recreational Ice Skating, "Recreational Ice Skating Catalog Spring 1997," Recreational Ice Skating Spring 1997, 2 pages (Back Cover Page), Published Mar. 1997 in U.S.

Sports Shop Rainbo, "Sports Shop Rainbo Catalog 1996," Sports Shop Rainbo 1996, 2 pages (p. 8) Publishing between Sep.–Nov. 1996 in U.S.

Sports Shop Rainbo, "Sports Shop Rainbo Catalog 1995," Sports Shop Rainbo 1995, 3 pages (p. 8), Published between Sep.–Nov. 1995 in U.S.

Jerry's Skating World Inc., Jerry's 1989–1990 Catalog, (pp. 7 and 12), Published in Canada 1989.

*Primary Examiner*—B. Dayoan

*Attorney, Agent, or Firm*—Fulwider Patton Lee & Utecht, LLP

[57] ABSTRACT

A contoured cover including lateral and medial panels constructed of thermally insulative, stretchable material. Lateral and medial panels are joined to form a unitary body having an ankle opening, a blade opening, and a pair of confronting front flaps. Flap fasteners and blade opening fasteners can be engaged to stretch taut the unitary body to closely conform to the boot outline and cover a substantial portion of the underneath of the boot.

17 Claims, 3 Drawing Sheets

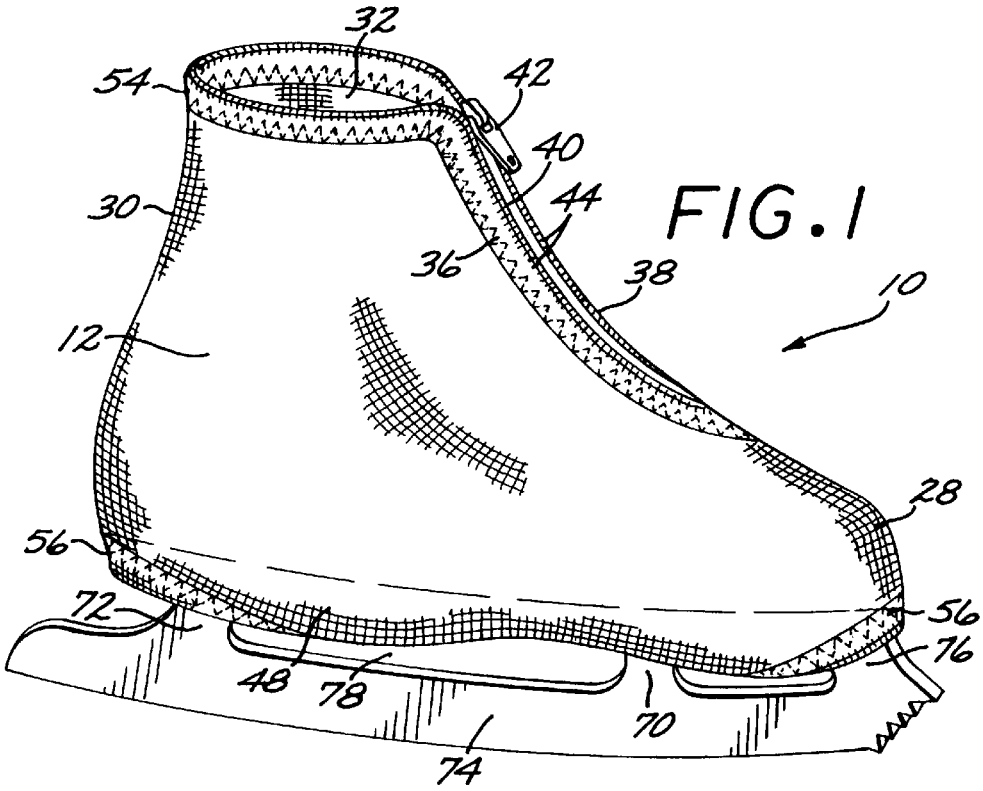
FIG. 1
FIG. 2
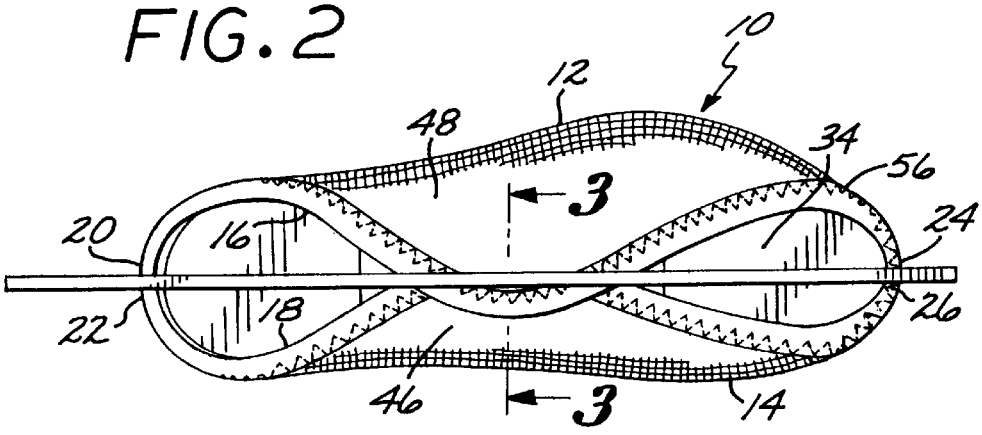
FIG. 3
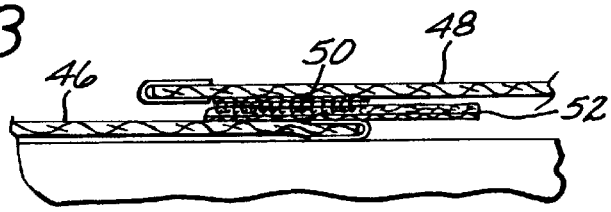

CONTOURED COVER FOR ICE SKATE BOOT

CROSS-REFERENCES TO RELATED APPLICATIONS

This application claims priority to Provisional Application U.S. Ser. No. 60/045,101, filed Apr. 25, 1997, which is hereby incorporated by reference.

BACKGROUND OF THE INVENTION

1. Field of the Invention

The present invention relates generally to covers for ice skate boots, and more particularly to contoured covers constructed of thermally insulative, stretchable material configured to closely fit the skate boot and substantially cover the sole of the skate boot when donned and fastened.

2. Description of the Prior Art

Ice skating as either a leisurely diversion or as a more serious athletic pursuit has been enjoyed for centuries. To participate, a pair of ice skates and a patch of trustworthy ice is all that is required. Shoe skates are generally comprised of a boot mounted on a thin blade. The boot is generally in the shape of a conventional shoe and constructed of leather. The blade is generally metallic, extends the length of the boot, and is attached at several points to the sole of the boot. The blade may additionally be configured to accommodate a particular sport. Conventional laces are used to secure the boot to the wearer's foot.

The availability of a suitable sheet of ice, while generally dictated by freezing outdoor conditions, has been increased by the advent of the indoor ice rink. Skating activities can be enjoyed all year around by a large segment of the population, including those in warmer climes.

Regardless of the skating venue, the proximity of the ice to the feet is such that heat is drawn away from the feet sometimes causing numbness and reducing ice time. Reduced warmth aggravates existing foot problems and limits the effectiveness of the skater. A continuing concern is therefore how to keep the feet warm.

The importance of warm feet in ice skating related sports such as figure skating, speed skating, and ice hockey is even more acute. All these sports involve long hours of training, including many hours of ice time to perfect maneuvers such as jumping, spinning, landing, and sudden turns and stops, which all generally require accurate positioning of the blade on the ice. The ability of the skater to "sense" the ice with his or her feet is important in completing these maneuvers thus necessitating some degree of warmth. In addition, maintaining warmth in the skater's feet serves to extend ice time thus extending the period of time tolerable for training purposes. To perfect these maneuvers prolonged exposure to the elements and the icy surface is of the utmost importance.

While numerous clothing designers have generated apparel designed to protect the wearer from the cold arising from outdoor conditions, the feet have generally been left poorly equipped. Thermally insulated socks are available to reduce heat loss. However, skating requires boots with a relatively secure fit and the laces pulled tight to ensure the support required to withstand the twisting moments generated during maneuvers performed to lift the skater off the ice by heights often exceeding several times that of the overall height of the blade. These thermally insulated socks are particularly unfit for the sport of figure skating where skaters are advised to wear the thinnest of socks, stockings, or even bare feet to increase their "sense" of the ice. Because of the tight fit, heated socks, which tend to be bulky, often serve to inhibit blood circulation within the foot thereby considerably reducing the flow of warmth to the foot and the feel of the skater's feet. Thus, the ability to retain heat through the use of internally situated devices is severely limited.

The need for an apparatus situated on the outside of the skate boot which retains heat can better be satisfied by a boot cover. One such cover has been proposed which includes a toe covering portion, an instep covering portion, and a heel covering portion. The cover is secured to the boot at the heel edge and laterally underneath through the use of Velcro fasteners. One such cover is disclosed in U.S. Pat. No. 4,445,287 to Garcia. While traveling forward or backward however, the transverse strap in Garcia is a significant impediment to the oncoming airflow. The leading edge of the strap directs the cold airflow upward toward the sole of the boot creating an increased rate of heat exchange.

Other covers are known to include an interior surface fabricated of a sock-like material and an outer surface having a wool-like appearance. These covers further include a series of hook and loop fasteners running up the back of the cover and an elastic band around the circumference of the lower opening. However, these devices have several drawbacks. These covers arc extremely air permeable and ill-fitting thus allowing for significant heat transfer. The elastic band is not durable and contributes to the poor fit over time. Additionally, the sole of the boot is significantly uncovered and the lower edges of the cover act to direct the cold air against this exposed sole surface causing yet more heat loss. These type of devices are more practical for activities such as coaching where the wearer is mostly stationary. Due to their loose fit, they are impractical to wear while performing intricate maneuvers and often result in entangling a blade.

Other covers are known to have an improved fitting over the previous device but lack a front fastening device allowing access to the laces and that cooperates with another set of fasteners and stretchable side panels to ensure a tight fit that entraps a layer of stagnant air. These devices also tend to direct air at the sole of the skate boot thereby increasing heat transfer away from the foot.

What is now needed is an improved cover that is thermally insulative and sufficiently stretchable to be pulled down underneath the sole of the boot while providing support to the skate boot which may break down over time. This cover should be releasably attachable to the boot whether or not the skate is being worn and provide access to the laces without having to remove the entire cover. Additionally, the cover should be durable and able to withstand differing weather conditions. The stretchable cover should cooperate with fastening devices to allow adjustment for differing fits. At the same time, this cover should be lightweight and tightly fitting so as to closely resemble the boot outline so that it doesn't impede performance. The contour of the cover should assist in directing air flow away from the sole of the boot. Consequently, these attributes contribute to longer periods of warmth in the skater's feet thus increasing dedicated ice time and allowing the skater to seek the perfection demanded to excel in sport-related activities.

SUMMARY OF THE INVENTION

The present invention provides a contoured cover incorporating lateral and medial panels joined together to form a unitary body that cooperates with two sets of fasteners to provide a tautly stretched fit over a skate boot as well as covering a substantial portion of the sole of the boot. The contoured cover may easily be removed or donned whether or not the skate is being worn. Adjustments may be made to maximize the coverage of the contoured cover to enclose as much surface area as possible with the blade attached to the boot. Access to the laces of the boot is available through disengagement of a flap fastener and without complete removal of the cover.

The present invention comprises, generally, a lateral and medial panel joined together to form a unitary body. The unitary body includes an ankle opening, a blade opening, and a pair of confronting front flaps. The panels are fabricated of a thermally insulative, stretchable material which cooperates with a pair of flap fasteners and a pair of blade opening fasteners to closely fit and resemble the outline of the skate boot and cover a substantial portion of the underneath of the sole of the boot thus entrapping a layer of insulating air between the cover and the boot.

Other features and advantages of the invention will become apparent from the following detailed description, taken in conjunction with the accompanying drawings, which illustrate by way of example, the features of the invention.

BRIEF DESCRIPTION OF THE DRAWINGS

FIG. 1 is a perspective view of an ice skate cover depicted on a boot and embodying the present invention;

FIG. 2 is bottom view of the ice skate cover shown in FIG. 1;

FIG. 3 is an enlarged cross-sectional view taken substantially along line 3—3 of FIG. 2;

DETAILED DESCRIPTION OF THE PREFERRED EMBODIMENT

Figure 4:
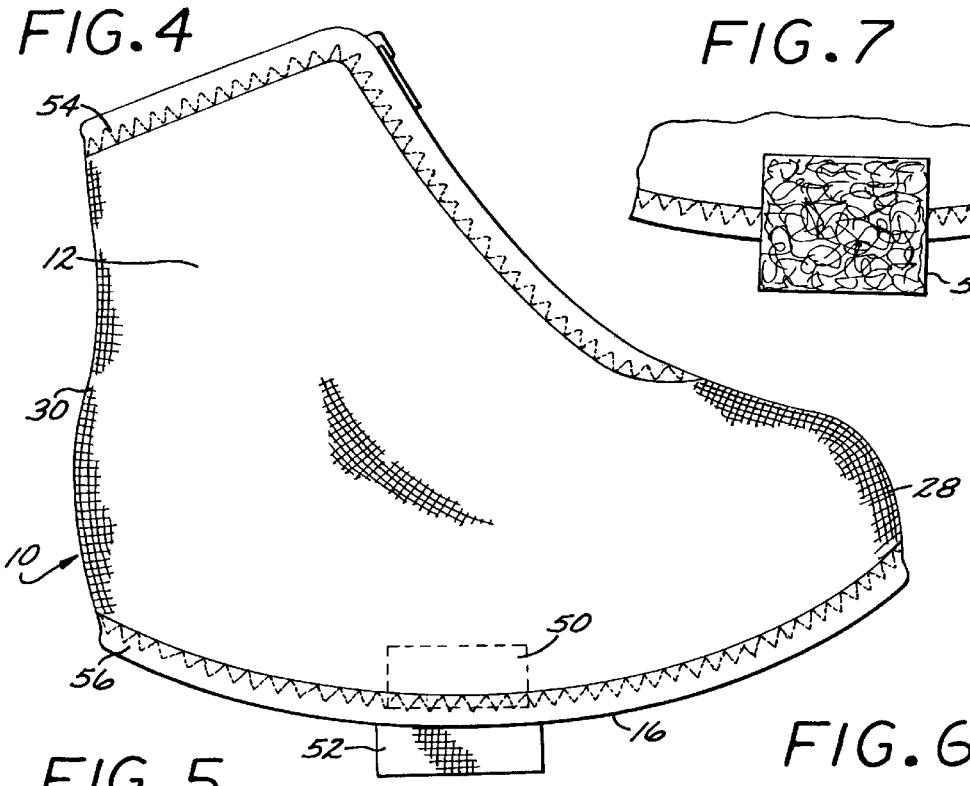
FIG. 4 is a side view, in enlarged scale, of the ice skate cover shown in FIG. 1.
Figure 7:
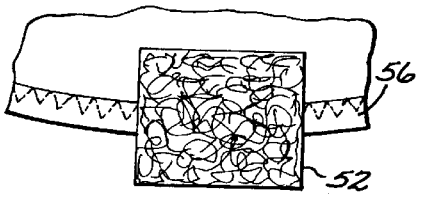
FIG. 7 is a detailed side view, in enlarged scale, taken along the line 7—7 of FIG. 6.
Figure 5:
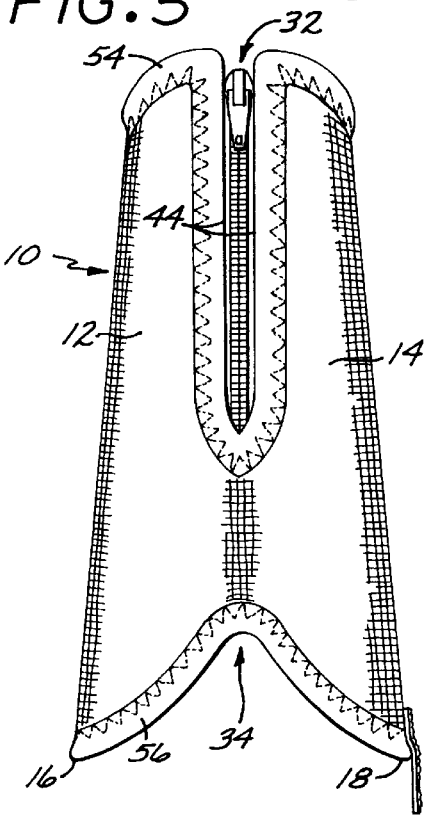
FIG. 5 is a front view of the ice skate cover in FIG. 4.
Figure 6:
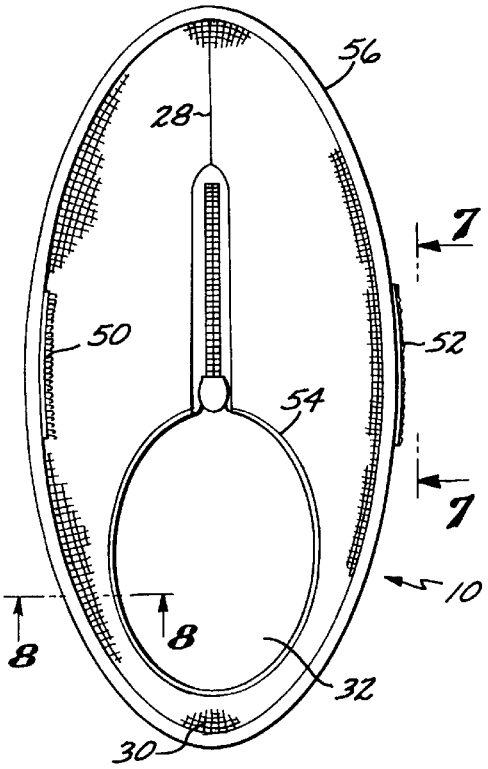
FIG. 6 is bottom view, in reduced scale, of the ice skate cover in FIG. 4.

Whether for leisure, training, or actual participation in skate related sports such as ice hockey, speed skating, or figure skating, warm feet are essential to the enjoyment and mastery of such ice skate related activities. More particularly, the sports of figure skating, speed skating, and ice hockey require the skater to perform a variety of difficult maneuvers such as jumping, crossovers, quick turns, and even more intricate footwork. To attain mastery of these skills, these sports require lengthy exposure to rink or outdoor conditions to acquire the necessary skill to perform these maneuvers.

While a variety of clothing is available to protect the skater's upper body, the skater's feet are often at the mercy of the cold. The addition of thermally insulated socks inhibits a closely fitting skate boot and may constrain circulation. Boot covers form an alternative for keeping feet warm. The need exists, however, for an improved cover that reduces heat loss from the skater's feet, provides additional support to the skate boot, and allows normal operation of the skater.

The cover of the present invention solves these problems by incorporating a pair of side panels constructed of a thermally insulative, stretchable material and joined together to form a lightweight unitary body configured to cooperate with two distinct fastening devices such that the contoured cover stretches taut to closely resemble the outline of the skate boot when slipped thereon and covers a substantial portion of the sole of the skate. The close fit and substantial coverage insures a layer of insulating air is trapped between the cover and boot.

It must be understood that while each of the figures that accompany the disclosure depicts a contoured cover that is meant to be worn on the right skate of a skater, every embodiment disclosed herein is equally adaptable to use on the left skate of the skater.

In accordance with the preferred embodiment of the present invention, and with particular attention to FIGS. 1 and 2, the contoured cover, generally designated 10, includes a lateral covering panel 12 and a medial covering panel 14. These panels are cut from sheets of thermally insulative, stretchable material forming sides or blanks and may come in a variety of colors. Configuration of the panels is determined by selecting a pattern closely matching a skate with a boot of predetermined configuration. While the lateral and medial covering panels 12 and 14 may generally have a thickness of about 1.0 mm to 7.0 mm, the preferred thickness is about 2.5 mm, consisting mostly of neoprene.

The medial and lateral covering panels 12 and 14 are configured with respective instep edges 16 and 18 and include respective vertical heel edges 20 and 22 and respective vertical forefoot edges 24 and 26. The lateral covering panel 12 and medial covering panel 14 are then joined together at their respective heel edges 20 and 22 and forefoot edges 24 and 26 to form a frontal scam 28 and a rearward seam 30 and resulting in the formation of a unitary body. Frontal scam 28 and rearward seam 30 generally follow the contour of their respective edges of the skate boot. The heel edges 20 and 22 and forefoot edges 24 and 26 are preferably sewn together but may be joined together by other joints such as adhesion.

The unitary body is configured at its top extent with an ankle opening 32, at its bottom extremity with a blade opening 34, at the front with first and second front flaps 36 and 38 terminating in confronting edges. Located on respective front flaps 36 and 38 is a first flap fastener element 40 and a second flap fastener element 42. The flap fastener elements 40 and 42 are sewn into the respective flaps 36 and 38 and preferably form a zipper but may comprise any commercially known fastener such as VELCRO. The first flap fastener element 40 and second flap fastener element 42 are configured to engage and draw a pair of confronting openable edges 44 on the respective first and second front flaps 36 and 38 together to cover the laces of the skate boot when the cover is on the boot.

Referring now to FIGS. 2, 3, and 4, medial and lateral skirts 46 and 48 are disposed at the lower extremities of their respective lateral and medial covering panels 12 and 14 and extend beneath the sole of the boot above the blade 74 and through a clearance opening 78 formed between an intermediate blade support 70 and a rearward blade support 72. The skirts 46 and 48 may be configured with an upward facing curvature that may be emphasized upon being stretched. A first blade opening fastener 50 is preferably located in the arch region and cooperates with a second blade opening fastener 52 secured on the opposite covering panel to draw their respective skirts 46 and 48 underneath the sole of the skate boot to partially overlap and resemble a figure eight pattern to cover substantially the entire central portion of the sole (FIG. 2). By assuming a figure eight shaped pattern, the skirts can cover substantially the entire sole between the intermediate blade support and rearward blade support as well as the lateral portions of the forward and heel regions of the sole of the boot. The overlap of the medial and lateral skirts 46 and 48 assists in directing air flow away from the sole of the foot. The blade opening fasteners 50 and 52 are preferably of the hook and loop variety such as VELCRO to allow for adjustment of the amount of skirt to be drawn under the sole of the skate boot by increasing the overlap of the skirts 46 and 48.

Attachment of the first and second blade opening fasteners 50 and 52 is shown in FIGS. 4–7. First blade opening fastener 50 is preferably sewn into the interior of the lateral side skill 48 with its lower extremity disposed above the lower extremity of the lateral side skirt 48. Second blade opening fastener 52 is located on the medial side skirt 46 and preferably sewn into and covers a portion of the exterior of the medial side skirt 46. The second blade opening fastener 52 also preferably extends below the lower extremity of the medial skirt 46 so as to provide a generous area of overlap that draws the skirts together in snug fashion thus tightening the unitary body about the skate boot. It can be appreciated that the blade opening fasteners may be located on either covering panel as long as they are oppositely disposed.

Providing additional strength to the unitary body are upper and lower bindings 54 and 56 as shown in FIGS. 1, 2, and 4–6. The upper binding 54 is secured, preferably sewn, about the periphery of the ankle opening 32 and extending down along the front flaps 36 and 38 and converging somewhere below the lower extremity of the first and second front fastener elements. The lower binding 56 is secured, preferably sewn, about the periphery of the blade opening 34. A zig zag tooth pattern is used to provide strength. It can be appreciated that the zipper can be sewn in before or after the upper binding is secured. However, it is preferable to sew the upper binding first leaving the ends free. The zipper is then sewn into the flap area followed by securing the free ends of the binding. Binding materials arc typically textile in nature such as lycra or nylon but other commercially available materials may be used.

Figure 8:
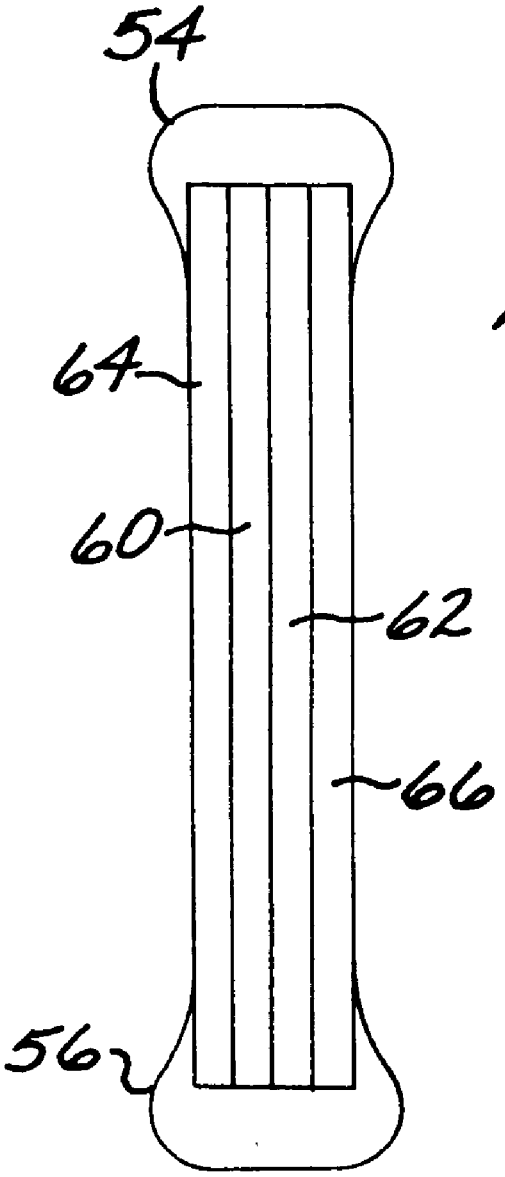
FIG. 8 is an enlarged cross-sectional view taken substantially along line 8—8 of FIG. 6.

Referring to FIG. 8, lateral and medial covering panels 12 and 14 (FIG. 2) arc preferably constructed of a plurality of layers, generally designated 58, providing the properties of thermal insulation, stretchability, and durability. These layers 58 include a first interior layer 60 and a second interior layer 62, an exterior layer 64, and a lining 66. In the preferred embodiment interior layers 60 and 62 are fabricated of neoprene and a thin adhesive layer containing a heat insulative additive sold under the trademark Titex, while exterior layer 64 and lining 66 are preferably fabricated of a textile materials such as lycra, nylon, double knitted nylon, terry cloth, polyester, fleece or other similar commercially available textiles. Titex is available from Nam Liong, (U.S.A.) Inc., Ontario, Calif. The layers 58 are laminately disposed with the exterior layer 64 and the lining 66 fused or adhesively attached to the Titex or neoprene layers 60 and 62. It is to be appreciated that the Titex layer doesn't add appreciably to the thickness of the panels or the weight but does add appreciably to the thermally insulative properties of the cover 10. A typical embodiment contains about 90 percent neoprene and about 10 percent textile material.

In use and in operation, the skater, may slip the cover 10 on in several methods. In the preferred method, the skater, before placing the skate on his or her foot, unfastens the first and second front flap fasteners 40 and 42 and the first and second blade opening fasteners 50 and 52. The skater then places his or her foot through the ankle opening 32 and pulls the cover 10 upward by grasping the periphery on either side of the ankle opening 32 until lower extent of the cover 10 is disposed above the skater's ankle near the calf. The skater then places the skate boot on in a conventional fashion and fastens the laces.

The skater may then pull the cover 10 down over the skate boot by grasping the medial and lateral side skirts 46 and 48 and pulling downward until the upper binding 54 is substantially disposed near the upper extent of the skate boot. The first blade opening fastener 50 is then folded inward and pulled underneath the arch area of the sole and held in place for engagement with a similarly folded and inwardly drawn second blade opening fastener 52. The skater then fastens the flap fasteners 40 and 42.

Adjustments are then made to the blade opening fasteners 50 and 52 by drawing more of the respective skirt 46 and 48 underneath the sole of the boot and refastening. Further adjustments in the toe and heel regions will be apparent to the wearer by pulling down the lowermost extremity of the frontal and rearward seams 28 and 30 underneath the sole of the skate boot to abut the respective rearward blade support 72 and forward blade support 76. Grasping of the upper binding 54 on both sides and pulling upward will further the snug fit provided for by the cover.

In another method, the skater may place the contoured cover 10 over the skate boot prior to placing the skate boot on the foot. This is accomplished by unzipping the first and second front flap fasteners 40 and 42 and unfastening the first and second blade opening fasteners 50 and 52 so that the blade opening 34 is ready to receive the skate boot. By grasping the lateral and medial side skirts 46 and 48 and pulling them down over the skate boot until the cover 10 is approximately aligned with the outline of the boot, the cover 10 is placed on the boot.

The first blade opening fastener 50 is then folded inward and pulled underneath the arch area of the sole and held in place for engagement with a similarly folded and inwardly drawn second blade opening fastener 52. The foot can then placed within the boot and laced up prior to engaging the first and second front flap fastener elements 40 and 42. Adjustments may be then made as discussed above.

Alternatively, the user may adorn the cover 10 while wearing the skate boot. In this situation, the user first unfastens the flap fasteners 40 and 42 and the blade opening fasteners 50 and 52. Next, the user inserts the front part of the blade of the skate through the ankle opening 32 of the cover. The user may then pull the rear edge of the upper binding 54 which is then pulled upward and stretched over the rear portion of the blade. By continuing pulling upward until passing over the tip of the blade, the user may dispose the cover 10 above the blade and onto the boot. The upper edges of the cover 10 may then be pulled to align the cover 10 with the outline of the boot. The blade opening fasteners 50 and 52 are then engaged and followed by the flap fasteners 40 and 42 as well as making similar adjustments as already discussed above.

To remove the skate and still leave the cover 10 on, the flap fasteners 40 and 42 are disengaged and the confronting openable edges 44 are peeled back to expose the boot laces. The boot can then be unlaced prior to pulling the skate boot off the wearer's foot. In a similar manlier, the laces of the boot may be accessed for readjustment without having to remove the entire cover 10.

From the foregoing, it will be appreciated that the contoured cover of the present invention provides the necessary thermal insulative properties while adding strength and support to the skate boot. The stretchable material chosen for the lateral and medial panels cooperates with the fasteners to stretch the unitary body tautly to closely resemble the skate boot and complement the sleek profile of the boot as well as a substantial portion of the sole to prevent heat loss from occurring out the sole. These attributes and the lightweight design of the cover allow the skater to practice longer without impeding performance. The cover also protects skate boots from moisture and wear which extends their life.

It is also to be appreciated that the cover is sufficiently stretchable so that it may donned whether or not the skate is being worn. Further, the front flap fasteners assist in keeping the laces tight and in place while allowing easy access to the laces of the boot if adjustments are necessary. This provides a consistent fit over a longer period of time.

While a particular embodiment of the invention has been illustrated and described, various modifications can be made without departing from the spirit and scope of the invention, and all such modifications and equivalents are intended to be covered.

What is claimed is:

1. A contoured cover for an ice skate boot having a sole and a blade spaced apart from said sole by forward, intermediate, and rearward blade supports having a clearance opening centrally thereunder between the intermediate and rearward blade supports and comprising:

a lateral covering panel constructed of a thermally, insulative, stretchable material;

a medial covering panel constructed of a thermally, insulative, stretchable material joined to said lateral covering panel to form a unitary body configured to be fitted in stretched close fitting relation when slipped over said boot, said unitary body being configured in its top extremity with an ankle opening and at its bottom extremity with a blade opening and flanking first and second front flaps terminating in confronting openable edges to be disposed over the instep region of said skate boot when said cover is donned on said boot;

first and second flap fastener elements mounted on the respective said first and second front flaps and configured to be releasably engagable together to hold said panels in stretched conforming relationship on said boot;

lateral and medial cover skirts projecting downwardly from said respective lateral and medial covering panels, said skirts configured to, when said cover is on said boot, be drawn inwardly from opposing sides through said clearance opening to cover the central underside of said sole, a first skirt fastener disposed at the lower extent of said lateral skirt; and a second skirt fastener secured to said medial skirt and configured for overlapping releasable engagement with said first skirt fastener beneath the sole of the boot, whereby said body may be stretched to mount in close fitting relationship on said boot and said skirts stretched downwardly and laterally inwardly under said sole with said fasteners engaged to hold said cover in close fitting relationship on said boot.

2. A contoured cover as set forth in claim 1 further including:

an upper binding formed on said body about the periphery of said ankle opening; and a lower binding formed on said body about the periphery of said blade opening.

3. A contoured cover as set forth in claim 1 wherein:

said lateral and medial covering panels are about 1.0 mm to 7.0 mm thick.

4. A contoured cover as set forth in claim 1 wherein:

said lateral and medial covering panels are constructed of about 90% neoprene and about 10% textile material.

5. A contoured cover as set forth in claim 1 wherein:

said lateral and said medial covering panels are constructed from discrete blanks patterned to closely fit the contour of said boot and terminating in respective flanking instep edges and configured in the forefoot region with vertical forefoot edges and configured in the heel region with vertical heel edges, said cover further including stitching joining the respective forefoot and heel edges.

6. A contoured cover as set forth in claim 1 wherein:

said first skirt fastener includes a plurality of hooks; and said second skirt fastener includes a plurality of loops.

7. A contoured cover as set forth in claim 1 wherein:

said lateral and medial covering panels are constructed of a plurality of layers laminately disposed.

8. A contoured cover as set forth in claim 7 wherein:

at least one of the layers is fabricated of a textile material.

9. A contoured cover as set forth in claim 7 wherein:

at least one of said layers is an adhesive which includes a heat insulative additive.

10. A contoured cover as set forth in claim 7 wherein:

at least one of said layers is fabricated of neoprene.

11. A contoured cover as set forth in claim 1 wherein:

said first and second flap fastener elements are continuous along respective said flaps.

12. A contoured cover as set forth in claim 11 wherein:

said first and second flap fastener elements are in the form of a zipper.

13. The contoured cover of claim 1 wherein:

said medial and lateral skirts are constructed to, when said cover is on said boot, abut said rearward and intermediate blade supports.

14. The contoured cover of claim 1 wherein:

said medial and lateral skirts are configured with curved lower extremities in the longitudinal direction along the length of said sole to form a figure eight shaped blade opening when said cover is on said boot.

15. The contoured cover of claim 5 wherein:

said forefoot and heel edges extend beneath said sole of said skate boot to abut said respective forward and rearward blade supports, when said cover is on said skate boot.

16. The contoured cover of claim 1 wherein:

said lower extremity of each said respective skirt is constructed to be drawn inwardly past a longitudinal centerline formed by said sole.

17. A contoured cover for use with an ice skate boot including an upper having predetermined configuration and a sole spaced away from a blade by a clearance opening between blade supports and comprising:

a pair of stretchable, thermally insulative, side panels having confronting forefoot and heel edges, said panels being joined together at said edges to form a unitary body for covering said upper and including an ankle opening, an instep opening flanked by a pair of confronting flaps to be releasably secured by a zipper, a forward edge that extends beneath said sole to abut said forward blade support, and a blade opening, said side panels further including free bottom edges curving downwardly from the forefoot and heel extremities to form integral cover skirts having complementary hook and loop fastener elements, said skirts being constructed to, when said cover is on said boot, to be drawn inward under the sole through said clearance opening to overlap in a vertical plane passing through the centerline of said sole and releasably engage said fastener elements thereby substantially covering the sole of the boot.

* * * * *

UNITED STATES PATENT AND TRADEMARK OFFICE

CERTIFICATE OF CORRECTION

PATENT NO. : 5,956,867

DATED : September 28, 1999

INVENTOR(S) : Juliette Harton

It is certified that error appears in the above-identified patent and that said Letters Patent is hereby corrected as shown below:

Column 4, line 32, delete "scam" and insert --seam--;

Column 4, line 34, delete "scam" and insert --seam--;

Column 5, line 15, delete "skill" and insert --skirt--;

Column 6, line 62, delete "manlier" and insert --manner--.

Signed and Sealed this

Twenty-fifth Day of April, 2000

*Attest:*

Q. TODD DICKINSON

*Attesting Officer*

*Director of Patents and Trademarks*